United States Patent [19]

McGreevy

[11] 4,318,098

[45] Mar. 2, 1982

[54] SIGNS

[76] Inventor: Roy McGreevy, c/o Post Office, Silverdale, New Zealand

[21] Appl. No.: 101,796

[22] Filed: Dec. 10, 1979

[30] Foreign Application Priority Data

Dec. 8, 1978 [NZ] New Zealand ..... 189130

[51] Int. Cl.[3] ..... G09G 3/16

[52] U.S. Cl. ..... 340/764; 340/378.5; 340/806

[58] Field of Search ..... 340/764, 378.2, 378.5, 340/806

[56] References Cited

U.S. PATENT DOCUMENTS

| | | | |
|---|---|---|---|
| 808,884 | 1/1906 | Thomas et al. | 340/764 |
| 3,283,427 | 11/1966 | Winrow | 340/764 |
| 3,307,170 | 2/1967 | Aoyama et al. | 340/764 |
| 3,469,258 | 9/1969 | Winrow | 340/764 |
| 3,581,301 | 5/1971 | Stutz et al. | 340/764 |
| 3,680,083 | 7/1972 | Pihl | 340/764 |
| 3,924,226 | 12/1975 | Lacy et al. | 340/764 |
| 3,949,392 | 4/1976 | Caritato | 340/764 |
| 4,163,332 | 8/1979 | Salam | 340/764 |

*Primary Examiner*—Marshall M. Curtis
*Attorney, Agent, or Firm*—Wenderoth, Lind & Ponack

[57] ABSTRACT

A sign includes characters, each character being assembled from an array of elements. Each element presents one of at least two visual appearances and comprises a member pivoted to rotate about an axis. The elements are selected and caused to rotate as required.

10 Claims, 14 Drawing Figures

Fig.7.
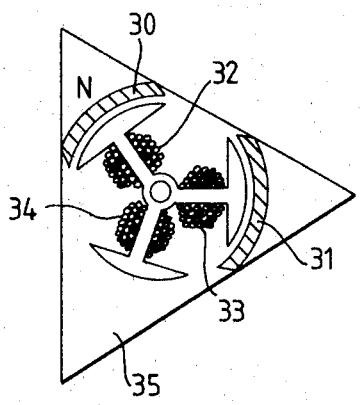
Fig.8.
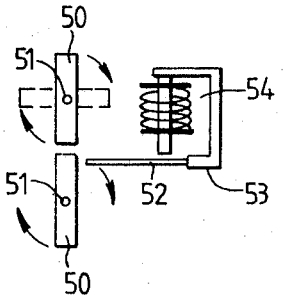
Fig.10.
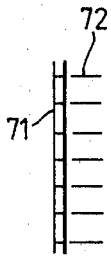
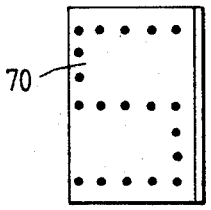
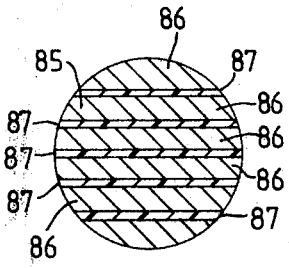
Fig.11.
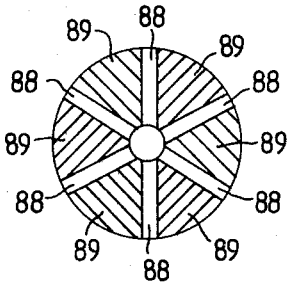
Fig.12.

SIGNS

BACKGROUND OF THE INVENTION

This invention relates to signs.

With signs at present available, particularly those known generally as changeable copy signs, it is not always possible to place a message on the sign in a simple manner or more particularly to change the sign in a simple manner. Frequently changing or placing a message requires a substantial input of manual effort.

Electronic signs which do not have this disadvantage have a further disadvantage in that such alternative constructions are expensive to produce and require a large capital investment thus reducing the opportunity for use of such more sophisticated electronic signs.

SUMMARY OF THE INVENTION

It is therefore an object of the present invention to provide a sign which will obviate or minimise the foregoing disadvantages or which will at least provide the public with a useful choice.

Accordingly the invention consists in a sign comprising one or more characters, the or each character being assembled from an array of elements, which elements are able to present one of at least two visual appearances so that by selecting elements and causing those selected elements only to present a particular desired visual appearance a desired character may be displayed, each element comprising a member pivoted to rotate about an axis. Drive means is provided to cause or allow the element to rotate about an axis, and selection means is operable to select elements.

To those skilled in the art to which this invention relates, many changes in construction and widely differing embodiments and applications of the invention will suggest themselves without departing from the scope of the invention as defined in the appended claims. The disclosure and the description herein are purely illustrative and are not intended to be in any sense limiting.

BRIEF DESCRIPTION OF THE DRAWINGS

One preferred form of the invention will now be described with reference to the accompanying drawings, in which:

FIG. 7 is a cross sectional view of a three-sided element for use in a sign according to the invention, FIG. 8 is a diagrammatic side elevation of part of an alternative sign according to the invention, FIG. 10 is a diagrammatic representation of one method of forming a selection means for use in a sign according to the invention, FIGS. 11 and 12 are cross sections of two alternative mounting rods for use in the invention.

DETAILED DESCRIPTION OF THE INVENTION

Figure 1:
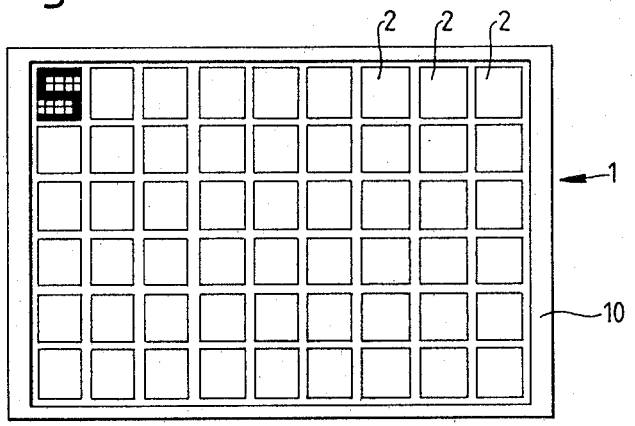
FIG. 1 is a diagrammatic front elevation of one form of sign according to the invention.
Figure 2:
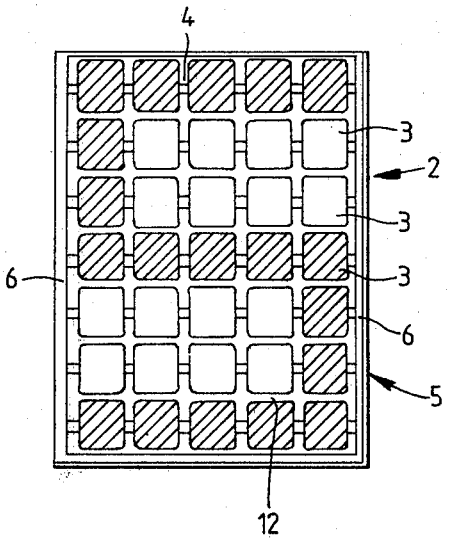
FIG. 2 is a diagrammatic front elevation of a character for use in a sign according to the invention.

In the preferred form of the invention a sign is constructed as follows.

The sign 1 comprises a number of characters or character forming members 2, each character 2 being formed by an array of elements 3 so that substantially all alphanumeric numbers and letters may be formed.

The elements 3 are supported for example, on rods 4, which may extend from a perimeter frame 5 surrounding each character 2, and preferably the side edges of each frame 5.

Figure 3:
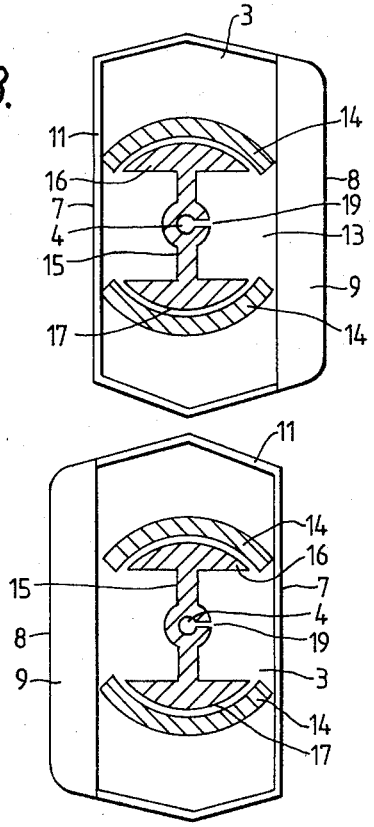
FIG. 3 is a cross-section in side elevation of a pair of elements for use in a sign according to the invention.
Figure 4:
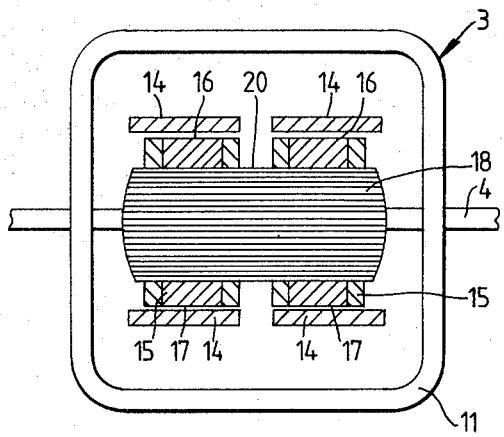
FIG. 4 is a cross-section in front elevation of one element of the type shown in FIG. 1, FIGS. 5 and 6 are diagrammatic side views of an alternative construction according to the invention.

Thus, referring to FIGS. 3 and 4, elements 3 may be provided as supported from rods 4 which may take the form, for example, of a hollow brass rod.

The elements 3 are substantially in the form for example, or discs or housings, rectangular or round as shown and have opposite faces thereon of different colours. Thus, a face 7 of the disc or housing may be black and the other face 8 for example, red or white, and preferably the distance between the rod 4 and the face 8 is greater than the distance between rod 4 and face 7 so that the faces 8 will stand out with respect to the faces 7 in use (see FIG. 3).

The faces 8 are preferably both fluorescent and reflective and for example, the front face, can have layer or coating 9 which is reflective such as the type of material used in motor vehicle reflectors and can be impregnated with fluorescent material. The remaining parts 11 of the elements can be of any suitable material such as plastics materials, or wood, or otherwise.

The whole construction is housed in a housing 10 which is enclosed on the rear and side faces so that any spaces such as space 12 between the elements 3 will show black or dark.

A drive means is provided to cause the elements to rotate and to this end space 13 may be provided within the element 3 which aperture may be substantially cylindrical. An electro magnetic means used to cause rotation is provided, for example, magnets 14 are provided in the element 3, the faces of the magnets 14 being circularly concave, and one magnet presents a north pole face to the cylindrical space 13 and the other magnet presents a south pole face into such space. Preferably two pairs of the magnets 14 are provided as can be seen in FIG. 4. The magnets 14 may define the space 13.

A stationary mounting member or armature 15 is provided fixed to the shaft 4 and the stationary mounting member 15 provides circularly convex surfaces 16 and 17 which support the element 3. Two stationary mounting members 15 are preferably provided.

One or more coils, preferably one coil 18 about the two stationary mounting members 15, is provided on the stationary mounting member, and the wiring for the coil 18 may be taken through the hollow rod 4 and brought out through a suitable aperture 19 therein. Thus, by reversing the current through the coil 18, the polarity at either end of the coil 18 can be made positive or negative as desired. The coils 18 form therefore an electro magnet.

Thus, if a current is passed through the coil so that the top end 20 of the coil 18 is a north face and the top magnet 14 presents a south face, the element 3 will be caused to rotate, as like faces repel.

The construction of FIG. 7 is similar except that the north and south faces of magnets 30 and 31 are positioned substantially at 120° to each other and three magnets, such as electro magnets 32, 33 and 34, are provided. By suitably controlling the current through these magnets the three sided element 35 may be caused to present any desired face to the direction from which the element will be viewed.

Figure 5:
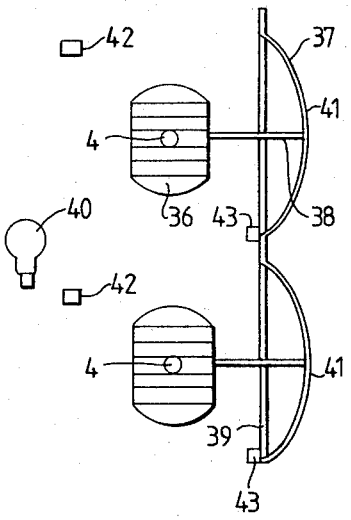
Figure 6:
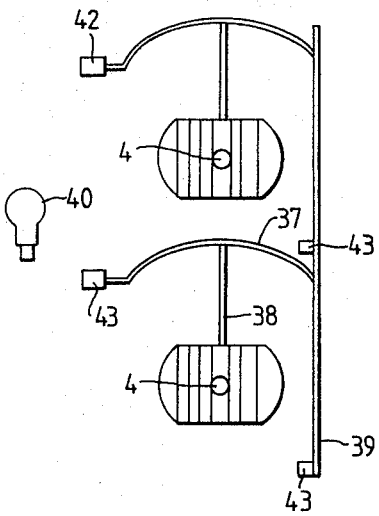

FIGS. 5 and 6 show an alternative construction in which a member 36 has contained therein a stationary mounting member formed substantially as shown in FIG. 3 but in which the magnets and armatures are positioned so that a substantially 90° rotation is obtained.

Mounted on the member 36 is a shield or shutter 37 which may be for example substantially concave when viewed from the member 36 and which may be mounted on a mounting arm 38.

An aperture is provided through the supporting housing, a wall 39 thereof being shown.

FIG. 6 shows the alternative position of the shutter 37, and thus the construction has a closed position wherein shutters 37 lie substantially in the same plane and an open position wherein shutters 37 lie in planes substantially parallel to each other.

A light source (diagrammatically at 40) is provided behind the shutters 37, and thus when a shutter 37 is opened light 40 can be seen and when the shutter 37 is closed, such as in FIG. 5, the light is in effect blanked out.

The outer face 41 of the shutter is preferably coated black or some other dark colour.

In order to stop the mechanism at a 90° rotation, there are provided suitable stops 42 and 43 against which the shutter 37 will abut.

The light 40 provided can be, for example, a fluorescent tube, or any other light source.

In an alternative construction (FIG. 8) members or elements 50 are provided which are mounted on a rod 51 in frictional engagement therewith. The drive means are then such as to rotate the rods 51 and in general, the elements 50 will rotate with the rod. A frictional pad may be provided within a transverse aperture in the elements 50 to provide suitable frictional engagement between the elements 50 and the rod 51.

In order to prevent an element from rotating, that is to say, to keep a selected face facing forward, a stop is provided such as a finger 52 which is preferably mounted on a spring 53 so that the finger 52 may move in a transverse direction. In order to cause the finger to move an electro magnet 54 may be provided which when electrified will cause the finger 52 to move for example, upwardly, as shown in FIG. 8, thus, releasing the element 50 to allow rotation. The current to the coil is held only momentarily so that the element comes to a stop against the finger 52 after a 180° turn. The opposite face will then be showing forward, and again in general one face would be marked black and the other red or white for example.

Figure 9:
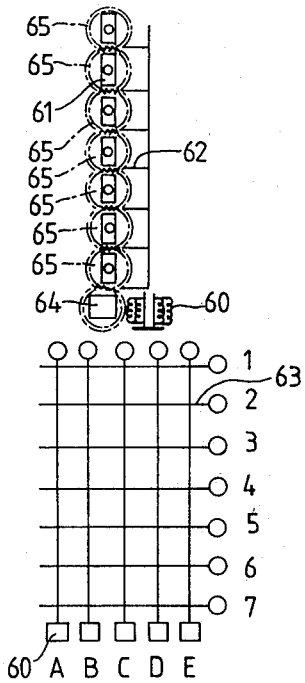
FIG. 9 is a diagrammatic representation of a control mechanism for use in the invention showing side elevation and rear views.

Referring to FIG. 9, a construction is shown wherein there is only one electro magnet, for example electro magnet 60, for a number of vertical elements such as 61. Thus, for one character there would be five electro magnets instead of 35 as required in general in the previously described methods. Each electro magnet 60 is associated with seven fingers 62 to hold each element 61 in vertical row. Operation is then as follows. The elements 61 are mounted on shafts such as 63 and one shaft 63 is selected and rotated. For this rotation each electro magnet 60 is either on or off and when, for example, the topmost shaft 63 rotates, the elements 61 of the topmost horizontal row will rotate depending on whether or not the appropriate electro magnet 60 is on or off.

After this rotation has taken place, then the second topmost shaft 63 is rotated, and so on. Although in each case, for example, all elements in one vertical row are released, only the elements on the shaft 63 being rotated at that time will in fact rotate.

The drive means may comprise a motor 64 which through cogs 65 drive all seven horizontal shafts 63. The horizontal shafts 63 may of course pass through a group of modules.

It is of course envisaged that the shafts could extend through a number of characters and also that the fingers 62 could be extended through a number of characters vertically. Substantially the same method of control could be used.

Selection means are provided to enable the correct elements to be selected for a character and, for example, a manual construction may provide cards such as cards 70 having apertures therein corresponding to elements which are to be selected to present particular faces to form a character (FIG. 10). An electrically conducting contact plate 71 and a number of pins 72 are provided. The card 70 is then placed on the contact plate 71 and the pins 72 which correspond to the positions of apertures in the card 70 pass through such apertures and contact the plate 71. Suitable circuitry such as direct connections by microswitches or printed circuit board contacts is provided and completed by the pins 72 to cause the appropriate electro magnets to switch on or off as required. Thus the plate 71 and pins 72 are coupled directly to the elements and a pulsing device, such as a manual push button, is provided to operate a power supply to cause rotation.

To change the signs the current is reversed while using the same card in order to reset the construction. Then a further card is inserted and other elements will move to form a different character.

Automatic control may be achieved by the application of micro-processor circuitry. A keyboard, for example similar to a typewriter keyboard, is used and messages for example typed thereon such as sports results are keyed onto or cleared off as required. A control box for each character includes one integrated circuit per character and by switching circuitry different pulses can be directed to the proper elements. In this application a time delay will be required from the time that one character is selected to the next but this can be relatively short and thus messages can be keyed at a fairly rapid rate.

Figure 13:
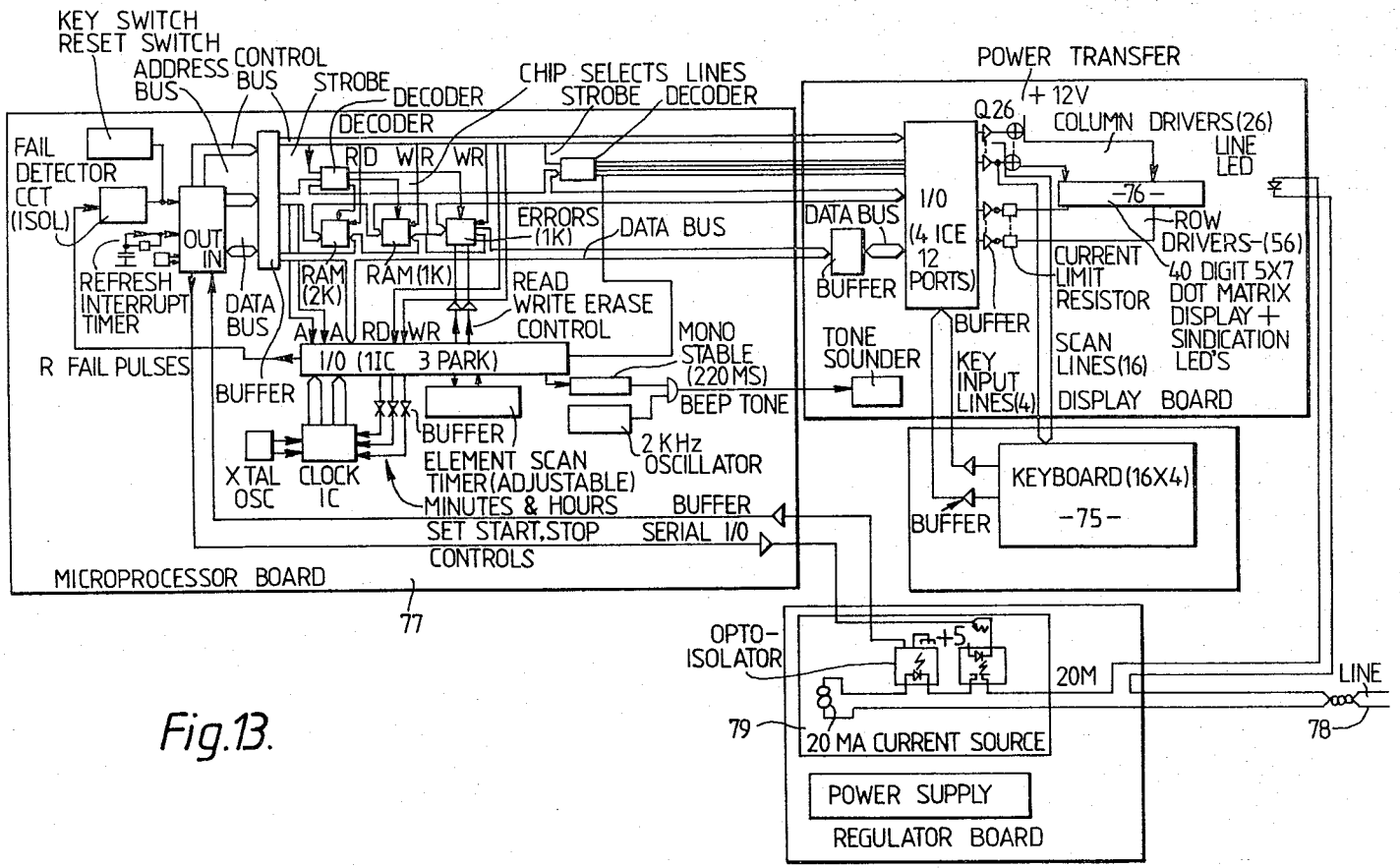
FIGS. 13 and 14 are circuit diagrams for automatic sign control for console circuitry and sign circuitry, respectively.
Figure 14:
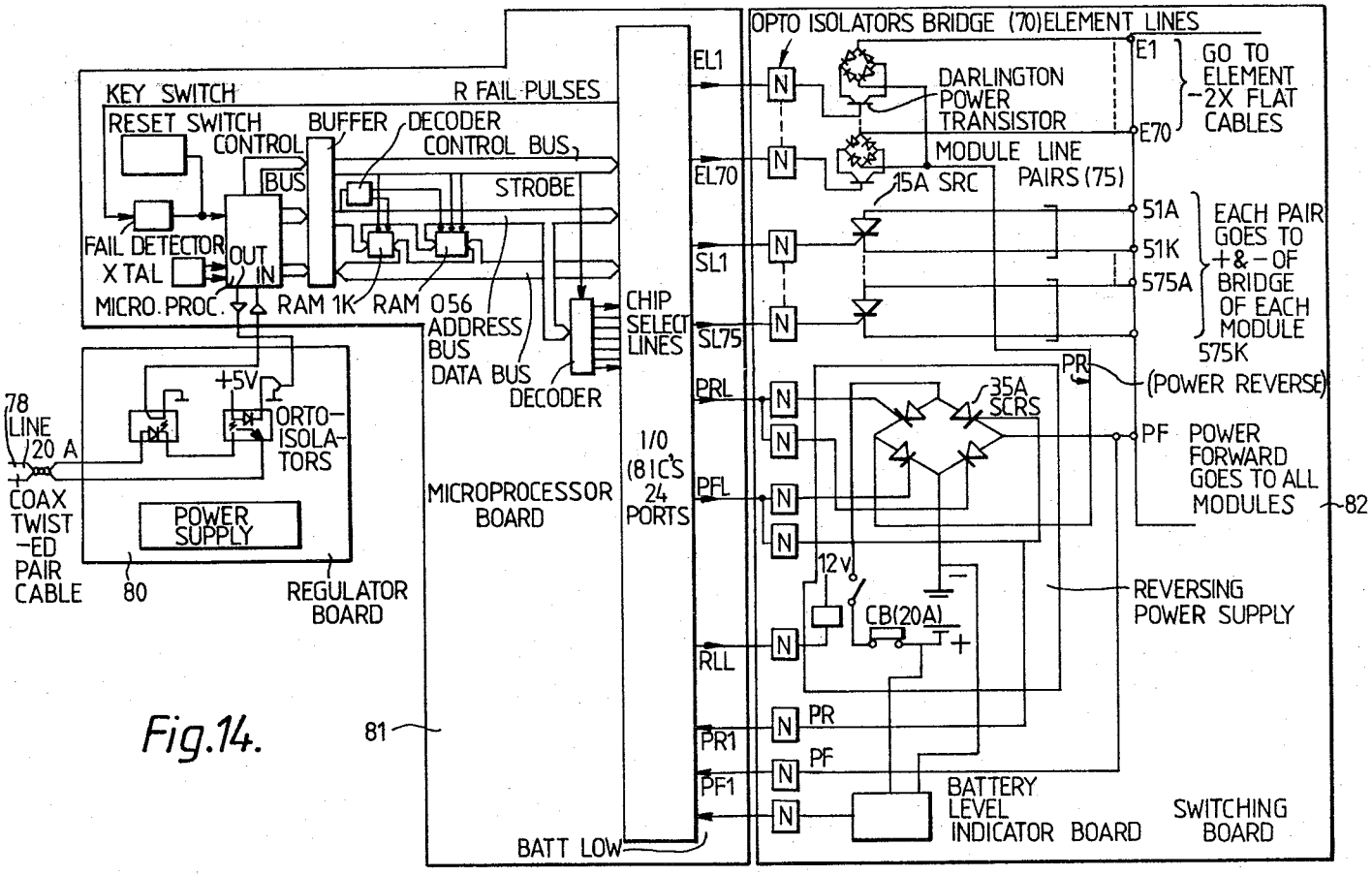

Pressing keyboard 75 (FIG. 13) brings the selected letter or other symbol up on LED display console 76. A complete message line may be assembled on the LED display and the message is either transferred to memory or manually passed on.

When the message is to be transferred to the sign the message is passed through micro-processor board 77 which codes the message to enable transfer of the message to a 35 matrix and also transfers the message into coded pulses which are in turn multiplexed to a form suitable for transmission by a two core shielded cable 78.

An isolating system 79 is provided to prevent unwanted feedback from the shielded cable. All power for the console is provided from the sign end.

The message is fed through cable 78 to an isolating and power supply circuit 80 (FIG. 4) and then through the micro-processor 81 via multiplexing which decodes the signal back to 35 matrix code, and the appropriate signal is transferred through switching unit 82 to the appropriate element 3.

Wiring of the modules is achieved by each element 3 being parallelled together, and by use of bi-directional diode circuitry feedback is substantially prevented.

The physical contact from the switch box (units 80, 81 and 82) and modules is via computer ribbon such as 3M scotchflex (T.M.) being plugged into 3M sockets mounted on printed circuit board on the module.

The hollow shaft 4 on the electro magnet models could be replaced by a composite solid shaft 85 (FIG. 11) made up of alternative layers of a conductor 86, e.g. brass, and an insulator 87, e.g. plastics material. This will mean that each 7×5 character 2 can be insulated from its neighbouring 7×5 character, for example by providing insulating blocks of inserts in the shaft 4. FIG. 12 shows an alternator segment having insulators 88 and conductors 89 in a radial pattern. Also this improvement will simplify assembly of a character 2.

Hence on one shaft there would be six conducting segments. At any point on the shaft the wires of an electro magnet can be simply soldered to a predetermined segment and the corresponding wire from the control mechanism can be soldered at the end of the shaft. One segment is provided for each of the five horizontal elements plus one common return. An insulator is provided between the shaft and the armature to prevent shorting.

The use of the invention is as follows.

The signs formed by the invention can be used in a wide range of applications where systematic signs are required such as supermarket carparks, shopping center carparks or hotel carparks or inside supermarket shopping centers and the like for example, to advertise particular products for example, that are being sold at a special price or to advertise entertainment or the like.

Also they could be used in, for example, auction houses to list and describe articles. Also transportations terminals may display arrival and departure times and similar messages.

It is also believed that the construction would have uses for example, in shop windows, in universities or schools, post offices, trade fairs and exhibitions, cafeterias, petrol stations, at sport events as bill boards and movie houses, news boards for stock exchange information, car sale yards, office locations, situations vacant and in a multitude of other applications.

In each case the systematic signs allow a message to be placed in a simple manner without the need to touch the sign itself. Also the signs herein described will present an attractive visual appearance which is desirable.

Thus, it can be seen that a sign is provided which at least in the preferred form of the invention has the advantage that the messages on the signs may be readily and simply placed thereon in an effective and attractive manner and in which the messages can be changed even with great frequency, for example, from a control room.

I claim:

1. A sign comprising:

at least one character forming member formed of an array of housings;

each said housing having at least two different exterior visual appearance portions;

each said housing having therein a space having a longitudinal axis;

a stationary mounting member having parts thereof positioned within said space, said housing being mounted about said parts of said stationary mounting member for rotation about an axis thereof coincident with said longitudinal axis;

said housing having therein permanent magnets rotatable with said housing about said axis and having opposite north pole and south pole magnetized faces generating therebetween a permanent magnetic field;

said stationary mounting member carrying reversible magnetic filed generating means for generating a reversible magnetic field and forming reversible north pole and south pole faces presented to said magnetized faces of said permanent magnets, and for, upon reversal of said magnetic field, causing said permanent magnets and said housing to rotate about said axis to thereby display a given said appearance portion;

said reversible magnetic field generating means being substantilly physically contained within said housing and within said permanent magnetic field between said permanent magnets; and selection means operably connected to said reversible magnetic field generating means for selectively rotating desired said housings to achieve a desired visual display of said array of housings.

2. A sign as claimed in claim 1, wherein said reversible north pole and south pole faces formed by said reversible magnetic field generating means comprise convex surfaces of said stationary mounting member, and said north pole and south pole faces of said permanent magnet comprise convex surfaces rotatable about said convex surfaces during rotation of said housing.

3. A sign as claimed in claim 1, wherein said housing has three said exterior visual appearance portions, said housing has therein two said permanent magnets spaced from each other about said axis by an angle of approximately 120°, and said reversible magnetic field generating means forms three magnets, equally spaced about said axis, on said stationary mounting member, each said magnet having reversible poles.'

4. A sign as claimed in claim 1, further comprising a rod supporting a plurality of said housings, said rod extending through said stationary mounting members, along said longitudinal axes of said spaces, of said plurality of housings.

5. A sign as claimed in claim 4, wherein said reversible magnetic field generating means comprises at least one electromagnet.

6. A sign as claimed in claim 5, wherein said rod comprises a hollow rod, and wiring for said electromagnets of said plurality of housings extends through said hollow rod into said housings.

7. A sign as claimed in claim 5, wherein said rod comprises longitudinal conducting members spaced apart from each other by insulating members, said conducting members comprising wireing for said electromagnets of said plurality of housings.

8. A sign as claimed in claim 1, further comprising a shutter mounted on each said housing of said array of housings, each said shutter being mounted for movement through an angle of approximately 90°, such that said shutters may be aligned in a first position extending in a substantially planar alignment and in a second position extending substantially parallel to each other.

9. A sign as claimed in claim 8, further comprising a light source positioned to be visible through said shutters when said shutters are in said second position.

10. A sign as claimed in claim 1, wherein said array comprises five rows, each said row having seven housings.

* * * * *